US011318516B2

(12) United States Patent
Lazzati

(10) Patent No.: US 11,318,516 B2
(45) Date of Patent: May 3, 2022

(54) BENDING GROUP OF A PANELING MACHINE TOOL

(71) Applicant: OLMA S.R.L., Abbiategrasso (IT)

(72) Inventor: Alberto Lazzati, Abbiategrasso (IT)

(73) Assignee: OLMA S.R.L, Abbiatergrasso (IT)

( * ) Notice: Subject to any disclaimer, the term of this patent is extended or adjusted under 35 U.S.C. 154(b) by 682 days.

(21) Appl. No.: 15/999,824

(22) PCT Filed: Jan. 26, 2017

(86) PCT No.: PCT/IB2017/050402

§ 371 (c)(1),
(2) Date: Aug. 20, 2018

(87) PCT Pub. No.: WO2017/141124

PCT Pub. Date: Aug. 24, 2017

(65) Prior Publication Data

US 2021/0138523 A1 May 13, 2021

(30) Foreign Application Priority Data

Feb. 18, 2016 (IT) ..... 102016000017037

(51) Int. Cl.
*B21D 5/04* (2006.01)
*B21D 5/00* (2006.01)

(52) U.S. Cl.
CPC ..... *B21D 5/045* (2013.01); *B21D 5/002* (2013.01)

(58) Field of Classification Search
CPC ..... B21D 5/04; B21D 5/042; B21D 5/045; B21D 5/002; B21D 5/01
See application file for complete search history.

(56) References Cited

U.S. PATENT DOCUMENTS 4,783,984 A * 11/1988 Aschauer ..... B21D 5/045 72/319
2007/0266752 A1* 11/2007 Patuzzi ..... B21D 5/006 72/16.1
2014/0338417 A1* 11/2014 Codatto ..... B21D 11/22 72/426

FOREIGN PATENT DOCUMENTS

AT 399114 B * 3/1995 ..... B21D 5/045
AT 399114 T 7/2008
EP 1777017 A1 4/2007
ES 2005910 A6 4/1989
ES 2063658 A2 * 1/1995 ..... B21D 5/045
JP H404190925 A 7/1992

* cited by examiner

*Primary Examiner* — Debra M Sullivan
(74) *Attorney, Agent, or Firm* — Browdy and Neimark, PLLC

(57) ABSTRACT

A bending group of a paneling machine tool for manufacturing profiled elements by bending a sheet of sheet metal includes a main frame, and a blocking press able to block the metal sheet during the manufacturing steps. The bending group includes a first bending member and a second bending member, distinct from the first bending member, both suitable for carrying out at least a bending of at least a portion of the sheet of sheet metal, at least one of the first bending member and second bending member being mobile with respect to the other.

8 Claims, 4 Drawing Sheets

BENDING GROUP OF A PANELING MACHINE TOOL

TECHNICAL FIELD

The present invention relates to a bending group of a panelling machine and in particular to a tool for manufacturing profiled elements by bending sheets of sheet metal. The present invention has been developed with particular regard, even though not limitedly, to a bending group of a panelling machine tool.

PRIOR ART

A panelling tool machine of the known type is used for production of profiled elements using all types of sheet metal present on the market. A panelling tool machine is able to process metal sheets, pickled and pre-painted, stainless steel sheets, copper sheets, and, in general, sheets made of any ferrous material.

A panelling machine tool internally comprises a bending group especially suitable for bending metal sheets using a programmable process which, with a series of bends obtained on the sheet itself, configures the edges in different sections, for example C-, L- or T-shaped.

A bending group of the known type comprises a pair of blades fixed in proximity of the end portions of a blade-bearing structure that is substantially C-shaped. The blade-bearing structure is able to move in two preferential directions, of which a tangential direction and a perpendicular direction to the plane defined by the main surface of the metal sheet. In this way, the two blades are able to describe a same curved trajectory with two degrees of freedom, horizontal and vertical, alternatingly entering into contact with the metal sheet in order to plastically deform it.

However, the movement means of the blade-bearing structure and the conformation thereof have objective mechanical limitations and enable realising bends of a limited height while not enabling a double-thickness bend.

EP1777017 describes a device for bending a blank comprising a support, a clamp, a mobile bending tool with two arms supported by a structure and movable with respect to the support structure and each other. AT399114 discloses a bending machine with a bending rocker, a front-mounted bend-up tool, a pivotable tool holder and a bending arm that can operate alternately as a bending machine. ES2005910 describes a sheet folding machine comprising two modules: the upper one provided with a pressing element and a bending element, the lower one provided with a fixed table and another bending element; the pressing element and the two bending elements are all driven by respective hydraulic cylinders. JP404190925 discloses a bending machine comprising a lower and an upper stand pressing a metal sheet there between, a couple of bending die devices freely slidable forward and backward.

Thus, numerous experimentations made by the present Applicant have demonstrated the need to further increase the velocity for manufacturing a product of the above-described type.

The aim of the present invention is therefore to provide a solution for this need and overcome the drawbacks of panelling tool machines of the known type.

DESCRIPTION OF THE INVENTION

An embodiment of the present invention relates to a bending group of a panelling machine tool for manufacturing profiled elements by bending a sheet of sheet metal, comprising:

a main frame, a blocking press for blocking the metal sheet during the manufacturing steps, a first bending member and a second bending member, distinct from the first bending member, both suitable for carrying out at least a bending of at least a portion of the sheet of sheet metal, at least one of the first bending member and second bending member being mobile with respect to the other.

With this solution, the panelling tool machine provides a greater operating flexibility as it is able to carry out, in a single step, different types of bending and a greater product manufacturing velocity, since while the first bender carries out a bending on the metal sheet the second bender is positioned for the subsequent bending operation.

A further aspect of the present invention relates to at least a first actuator device connected to at least the first folding element and to the main frame, and suitable for moving the first bending member with respect to the second bending member.

With this solution, all the movements of first bending member can be set by means of an actuator device that is independent and responsible for the movement of only the first bending member.

A further aspect of the present invention relates to a second actuator device connected to the second folding element and to the main frame, and suitable for moving the second bending member with respect to the first bending member.

With this solution, the first and the second bending members can be moved at the same time in distinct and/or different trajectories by means of two actuators that are independent of one another.

In a further aspect of the present invention the actuator devices are able to move the first bending member and/or the second bending member along a trajectory comprising at least a component of an axial vertical direction (Y-Y) and/or an axial horizontal direction (X-X).

With this solution, the bending members can be moved along any type of straight and/or curved trajectory.

In a further aspect of the present invention the bending group comprises:

a first support frame connected in a mobile way to the main frame along an axial horizontal direction (X-X) by means of the first actuator device, the first bending member being connected in a mobile way to the first support frame along an axial vertical direction (Y-Y).

In a further aspect of the present invention the bending group comprises:

a second support frame connected in a mobile way to the main frame along an axial horizontal direction by means of the second actuator device, the second bending member being connected in a mobile way to the second support frame along an axial vertical direction (Y-Y).

With this solution, it is possible to move the two bending members in a single axial direction or along two axial directions that are parallel to one another.

In a further aspect of the present invention, a process is disclosed for bending a portion of a sheet of sheet metal, comprising following steps:

predisposing a blocking press for blocking the metal sheet during the manufacturing steps, predisposing a first bending member (30) and a second bending member (40), distinct from the first bending member (30), predisposing at least a first actuator device (36, 38) connected to at least the first folding element (30), moving the first bending member (30) with respect to the second bending member (40) along a trajectory comprising at least a component of an axial vertical direction (Y-Y) and/or an axial horizontal direction (X-X).

BRIEF DESCRIPTION OF THE DRAWINGS

Further characteristics and advantages of the present invention will more fully emerge from the following description, made by way of example with reference to the accompanying figures of the drawings, in which.

BEST WAY OF CARRYING OUT THE INVENTION

Figure 1:
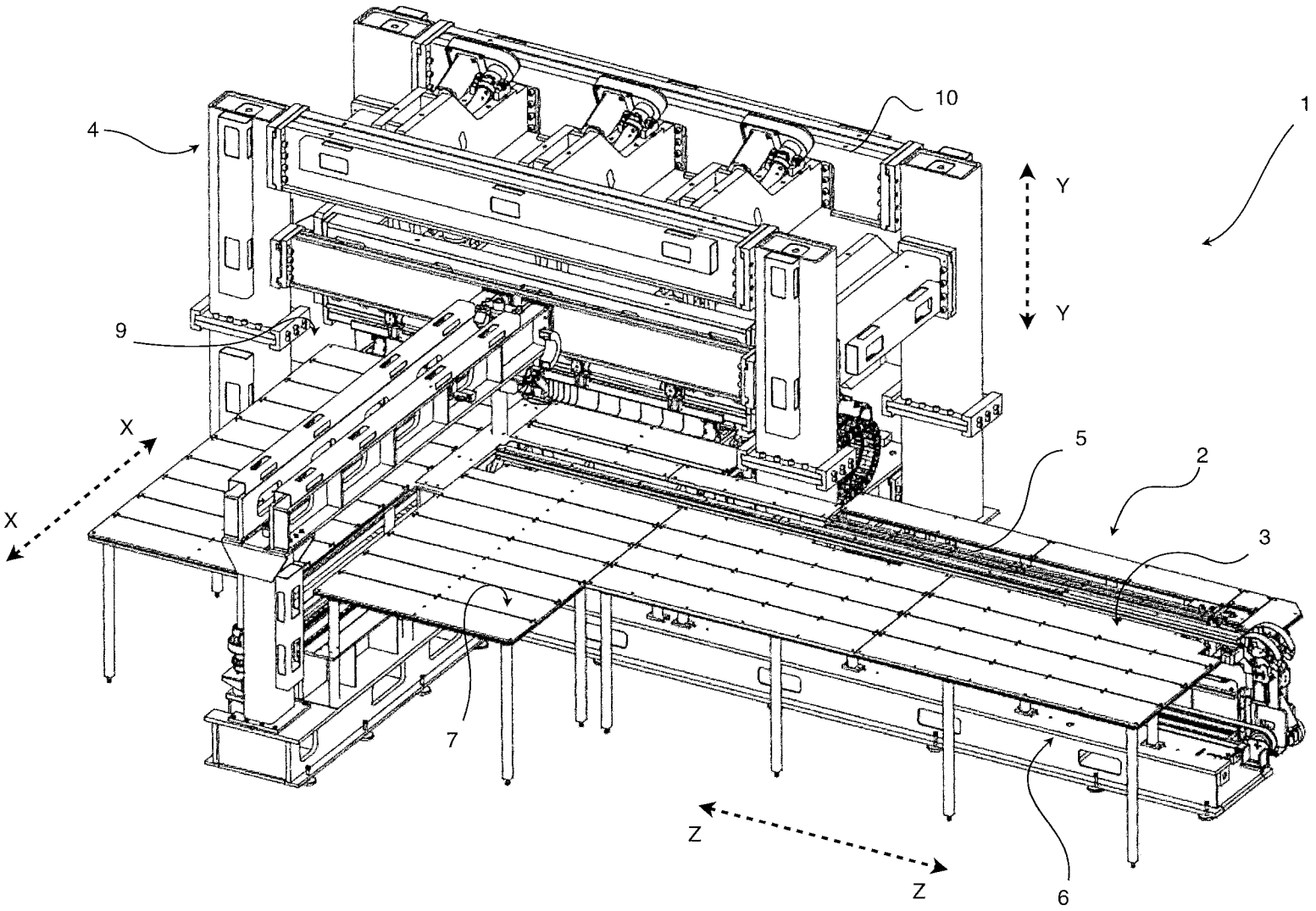
FIG. 1 is an axonometric view of a panelling machine according to the present invention.

With particular reference to the accompanying figures of the drawings, the panelling machine tool 1 according to the present invention comprises a loading station 2 of the material being processed, for example a metal sheet, a bending group 4 and an unloading station 6 of the finished product.

The distinction of the three areas constituting the assembly of the panelling machine tool 1 enables carrying out the processes in total safety in the case of manual infeed, or carrying out a completely automated working cycle, performed in the loading station 2 and in the unloading station 6 by dedicated equipment, realised by direct request of the user or, alternatively, by means of robotic devices equipped for the purpose.

The loading station 2 of the material being processed can comprise a first positioning plane 3, preferably a bench on an upper surface of which at least a sheet of sheet metal is positioned either manually or using robotic devices.

The upper surface of the first positioning plane 3 can comprise one or more reference abutments for enabling, in use, correct positioning of the sheet of sheet metal on the rest plane, and a plurality of openings.

The loading station can comprise a first positioning device, for example a transversal positioner 5 that includes a plurality of positioning organs of the metal sheet inserted internally of the openings of the positioning plane 3, and able to displace and position the metal sheet along a predetermined axial horizontal direction Z-Z, parallel to the plane defined by the upper surface of the positioning plane 3, in two opposite directions.

The loading station 2 can further comprise a second positioning plane 7, preferably a bench on an upper surface of which at least a sheet of sheet metal is positioned using the transversal positioner 5.

The second positioning plane 7 comprises a support plane that includes a plurality of sectors arranged flanked to one another, lowerable and/or excludable in order to enable a manipulation of metal sheets with a flat surface but projecting edges, with the aim of limiting the movement limits of the sheets of sheet metal.

The loading station can further comprise a second positioning device, for example a longitudinal positioner 9, which includes at an end thereof a gripping organ, for example a C-shaped structure at ends of which a press is applied, being particularly suitable for gripping and holding the sheet of sheet metal.

The longitudinal positioner is able to displace and position the metal sheet along a predetermined axial horizontal direction X-X, parallel to the plane defined by the upper surface of the positioning plane 7, and perpendicular with respect to the axial direction Z-Z, in two opposite directions.

The upper surface of both positioning planes 3, 7 can comprise a plurality of panels covered with bristles made of an artificial material (not illustrated), sufficiently sturdy for supporting the weight of the metal sheet and sufficiently rigid for enabling sliding thereof with a low coefficient of friction. A further advantage of this type of support is given by the high level of noise abatement which is generated during the step of bending the metal sheet.

Figure 2:
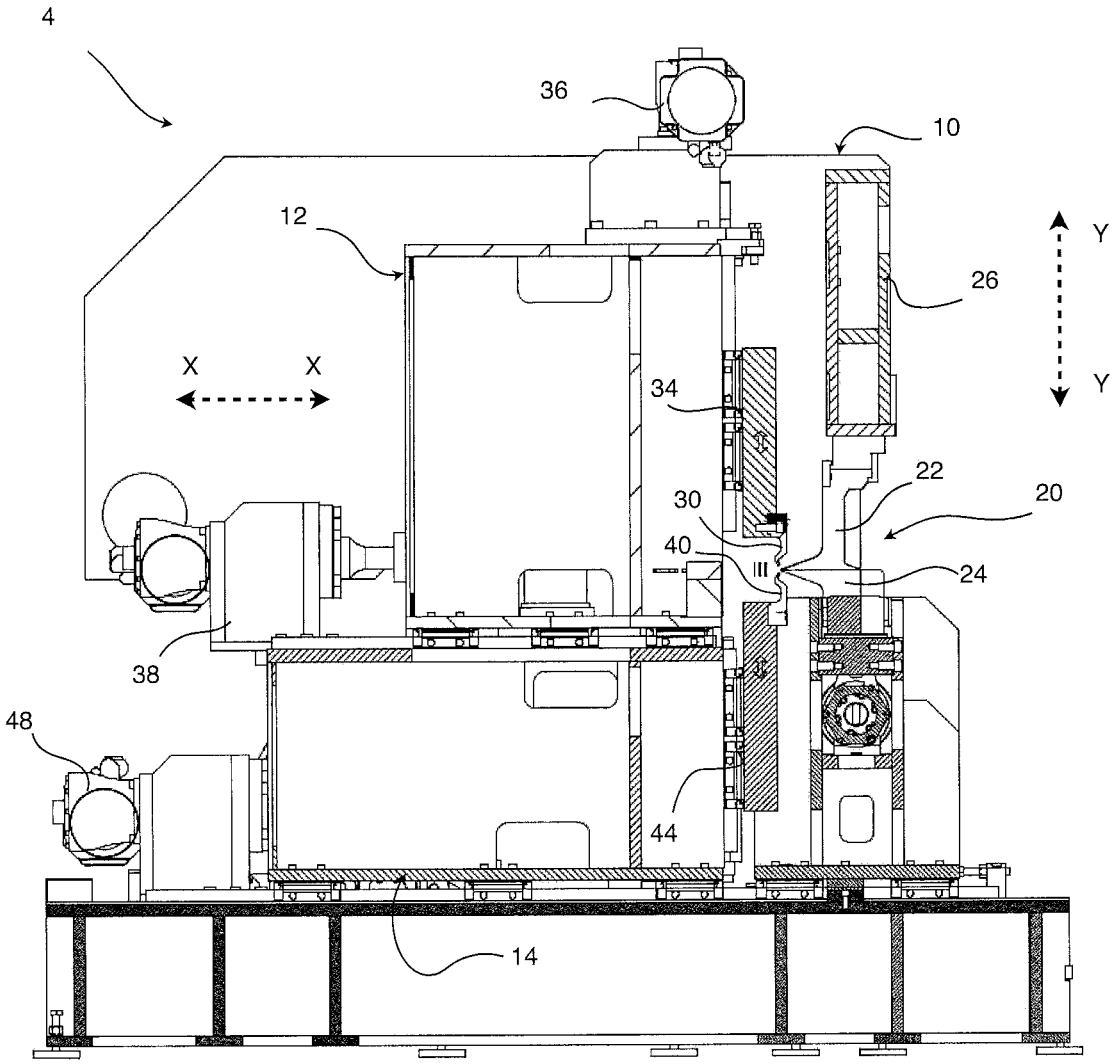
FIG. 2 is a partial view of a bending group according to the present invention.

As more fully illustrated in FIG. 2, the bending group 4 of the metal sheet can comprise a main frame 10 and a blocking press 20 connected to the main frame 10. The blocking press 20 can comprise an upper presser 22 and a corresponding lower presser 24, arranged opposite the upper presser 22. The upper presser 22 is connected to a movement device 26, fixed to the main frame 10, for example a hydraulic cylinder or an electric motor. The upper presser 22 is slidably connected to the main frame 10 and is mobile in use along a predetermined axial vertical direction Y-Y, perpendicular to the plane defined by the surface of the metal sheet, in two opposite directions, from an operating position, in which the upper presser 22 crushes the metal sheet against the lower presser 24, keeping it blocked in position, to a rest position, in which the upper presser 22 is raised with respect to the metal sheet and enables displacement thereof.

The bending group 4 can comprise a first folding element, for example an upper bending member 30 slidably connected by sliding guides 34 to a first support frame 12. The sliding guides 34 preferably have a low coefficient of friction for facilitating the movement of the upper bending member 30, including for small-degree displacements.

The bending group 4 can comprise a first actuator device 36 connected to the upper bending member 30 and to the first support frame 12 in order to enable, in use, displacement of the upper bending member 30 according to the axial vertical direction Y-Y perpendicular to the plane defined by the surface of the metal sheet and in both directions. The first actuator device 36 can comprise, for example, but not limitingly, a mechanical activating device or an oil-dynamic activating device.

The bending group 4 can comprise a second actuator device 38 connected to the first support frame 12 and to the main frame 10 in order to enable, in use, displacement of the first support frame 12 according to the axial horizontal direction Y-Y parallel to the plane defined by the surface of the metal sheet and in both directions. The first actuator device 38 can comprise, for example, but not limitingly, a mechanical activating device or an oil-dynamic activating device.

The bending group 4 can further comprise a lower bending member 40 slidably connected by sliding guides 44 to a second support frame 14 fixed to the main frame 10. The sliding guides 44 preferably have a low coefficient of friction for facilitating the movement of the lower bending member 40, including for small-degree displacements.

The bending group 4 can comprise a third actuator device (not illustrated) connected to the lower bending member 40 and to the second support frame 14 in order to enable, in use, displacement of the lower bending member 40 according to the axial vertical direction Y-Y of the upper bending member 30, perpendicular to the plane defined by the surface of the metal sheet and in both directions. The third actuator device can comprise, for example, but not limitingly, a mechanical activating device or an oil-dynamic activating device.

The bending group 4 can comprise a fourth actuator device 48 connected to the second support frame 14 and to the main frame 10 in order to enable, in use, displacement of the second support frame 14 according to the predetermined axial horizontal direction X-X of the first support frame 12, parallel to the plane defined by the surface of the metal sheet and in both directions. The fourth actuator device 48 can also comprise, for example, but not limitingly, a mechanical activating device or an oil-dynamic activating device.

Further conformations of the upper bending member 30 and the lower bending member 40, like the movement devices 36, 38, 48 described in the foregoing, are naturally possible as long as each bending member 30, 40 is connected to at least a movement device which enables displacing a first bending member 30 with respect to a second bending member 40.

For example, in a preferred embodiment of the present invention, the bending group 4 comprises at least a first actuator device 36 connected to at least one of the first and second bending members 30, 40 and to the main frame 10, and suitable for moving, in use, the at least a bending member 30, 40, according to a trajectory which comprises at least an axial component, preferably a component of the axial vertical direction Y-Y and/or the axial horizontal direction X-X. The bending group 4 further comprises a second actuator device connected to the other of the first and second bending member 30, 40 and to the main frame 10, and suitable for moving the other bending member 30, 40, according to a trajectory which comprises at least an axial component, preferably a component of the axial vertical direction YY and/or the axial horizontal direction X-X. With this conformation, it is possible to displace the first bending member 30 with respect to the second bending member 40.

In a further embodiment of the present invention, the bending group can comprise a single actuator device able to contemporaneously move the first bending member 30 with respect to the second bending member 40 along two trajectories distinct from one another and independent.

The unloading station 6 of the finished product can comprise a positioning plane, preferably a bench on an upper surface of which the profiled element, i.e. the metal sheet at the end of the bending process, is positioned. In a particularly advantageous configuration, illustrated in FIG. 1, the unloading station 6 coincides with the loading station 2 of the material being processed, as previously described. In this way, it is possible to further reduce the overall size of the panelling machine tool 1.

The panelling machine tool 1 of the present invention is made in such a way as to be able to work as a single and independent bending station of sheets of sheet metal, but also as one of a plurality of operating stations internally of a production line, for example in sequence to a punching station.

In use, a bending process of a sheet of sheet metal comprises steps of collecting a sheet of metal from a group of metal sheets present by a side of the panelling machine tool 1 and positioning the sheet on the positioning plane 3 of the loading station 2. The metal sheet is then "centred" on the positioning plane 3, i.e. aligned, by means of the positioning members which push it against one or more reference abutments, creating a zero point of the sheet. Once centred, the transversal positioner 5 displaces the metal sheet along a predetermined axial horizontal direction Z-Z, parallel to the plane defined by the upper surface of the positioning plane 3, towards the bending group 4.

When the metal sheet reaches the positioning plane 7 in proximity of the bending group 4, the longitudinal positioner 9 grips the sheet on a side thereof and displaces it along the predetermined axial horizontal direction X-X towards the bending group 4, until the metal sheet reaches a start-work position, i.e. when an end thereof is positioned at the blocking press 20. As will more fully emerge in the following, the longitudinal positioner 9 is moved with a step cycle in relation to the bending process.

When the metal sheet is at the blocking press 20, the upper presser 22 is in a rest position for enabling positioning of the metal sheet in a first bending position. Then the movement device 26 displaces the upper presser 22 downwards until it crushes and blocks the metal sheet against the lower presser 24.

Therefore, the movement devices 36, 38, 48 displace the upper bending member 30 and/or the lower bending member 40 in respective predetermined displacement trajectories, so that the bending members 30, 40 abut against a first portion of the metal sheet and exert a pressure that is sufficient to bend the first portion about an angle corresponding to the trajectory. The displacement trajectories can have a single perpendicular direction to the plane defined by the surface of the metal sheet, and therefore along the axial vertical direction Y-Y of the movement means, or can be the result of an interpolation of a movement along the axial vertical direction Y-Y and a movement along the axial horizontal direction X-X, parallel to the plane defined by the surface of the metal sheet. The interpolation of these two movements generates the displacement trajectory of each bending member 30, 40. By means of managing the interpolation of the two movements of each bending member 30, 40 the displacement spaces of the two components can be managed and therefore all the possible bending sequences.

The movement devices 36, 38, 48 can be activated independently of one another or can be activated at the same time, as a function of the type of bending that is to be imparted on the metal sheet and therefore as a function of the profiled product that is to be obtained. For example, it is possible to displace only the upper bending member 30 and therefore create a bend of a portion of the metal sheet in a downwards direction, or only the lower folding member 40 and therefore carry out a bending of one portion of the metal sheet upwards, or to contemporaneously displace both folding member 30, 40. If the trajectories of each bending member 30, 40 comprise only the axial vertical direction Y-Y, the bending towards one another and/or downwards of the portion of metal sheet will have a degree of curvature that is smaller than the degree of curvature of the bend, upwards and/or downwards, realised with trajectories that comprise the interpolation of both the axial directions X-X and Y-Y.

Once the bend/s of the first portion of metal sheet have been achieved, the movement device 26 lifts the upper presser 22 and frees the metal sheet and the longitudinal positioner 9 displaces the metal sheet along the axial horizontal direction X-X towards the bending group 4. Once the metal sheet has reached a second bending position, the movement device 26 displaces the upper presser 22 downwards until it crushes and blocks the metal sheet against the lower presser 24.

Therefore, the movement devices 36, 38, 48 newly displace the upper bending member 30 and/or the lower bending member 40 in respective predetermined displacement trajectories, as described in the foregoing, so as to obtain a predetermined bend of a second portion of the metal sheet.

Once the bend/s of the second portion of metal sheet have been achieved, the movement device 26 lifts the upper presser 22 and frees the metal sheet and the above-described operations are repeated up to completion of all the bends necessary for the first side of the metal sheet.

Once the bend/s of the first portion of metal sheet have been achieved, the longitudinal positioner 9 displaces the metal sheet along the axial horizontal direction X-X, distancing it from the blocking press 20 up until the metal sheet is external of the bending group 4. Then the longitudinal positioner 9 rotates the metal sheet so as to position another side of the metal sheet at the bending group 4.

Then the longitudinal positioner 9 newly displaces the metal sheet along the axial horizontal direction X-X towards the bending group 4, up until the metal sheet reaches a start-work position, i.e. when an end thereof is positioned at the blocking press 20. Then the above-described steps for the first side of the metal sheet are repeated for the second side and for all the following sides of the metal sheet up to completion of the piece being processed.

Figure 3:
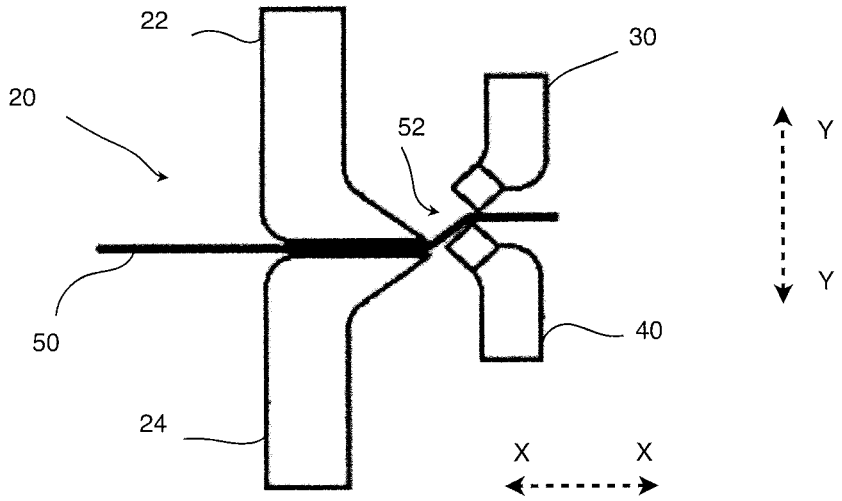
FIGS. 3 to 5 are schematic lateral views of the bending members of the bending group of FIG. 1 in different operating positions.
Figure 4:
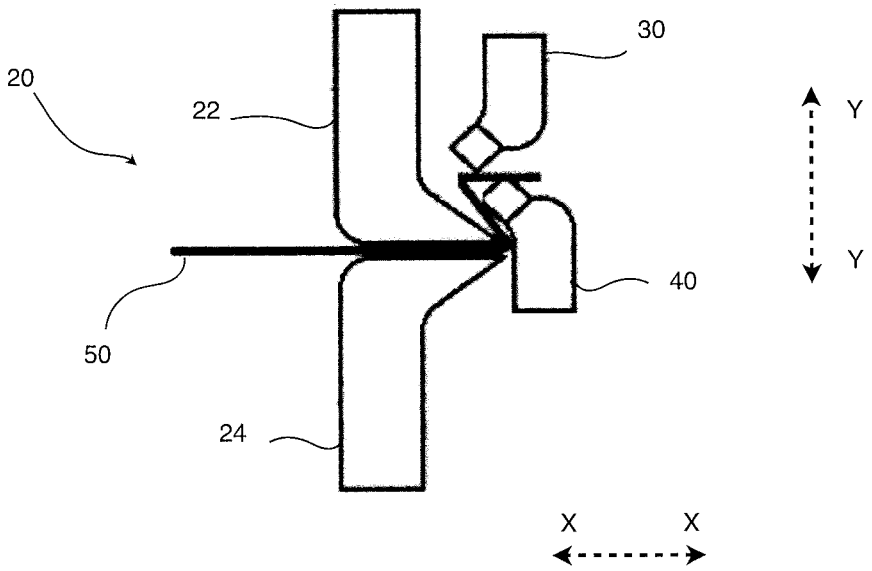

In a particularly advantageous embodiment of the bending process of the bending group 4 of the present invention, illustrated in FIGS. 3 and 4, it is possible to realise a Z-shaped bending of a portion 52 of a metal sheet 50 during a single step of the bending process. With particular reference to FIG. 3, once the metal sheet 50 is in position and blocked by the upper presser 22, the lower bending member 40 is displaced upwards along the axial vertical direction Y-Y beyond the plane defined by the upper surface of the metal sheet 50 and along an axial horizontal direction X-X so as to exert a pressure on an area of the portion 52 of metal sheet 50 and carry out a first bending. The upper bending member 30 is displaced downwards along the axial vertical direction Y-Y so as to exert a pressure on a second area of the portion 52 of metal sheet 50, and carry out a second bending. The two actions of the two bending members 30, 40 that displace along the same axial vertical direction Y-Y with different directions and therefore act contemporaneously on two different areas of the portion 52 of the metal sheet 50 enable obtaining an overall Z-shaped bending during a single step of the folding process.

As illustrated in FIG. 4, the bending group 4 of the present invention can also carry out a Z-shaped bending with an undercut. After having carried out the above-described steps and having made a first Z-shaped bend, the lower bending member 40 is further displaced upwards along the axial vertical direction Y-Y to a greater height so as to realise a first bend with an angle of about 90°. The upper bending member 30 is brought downwards along the axial vertical direction Y-Y so as to realise a second bend. Then the lower bending member 40 is displaced horizontally along the axial horizontal direction X-X, parallel to the plane defined by the surface of the metal sheet 50, towards the presser elements 22, 24, so as to realise a bend with an undercut.

Figure 5:
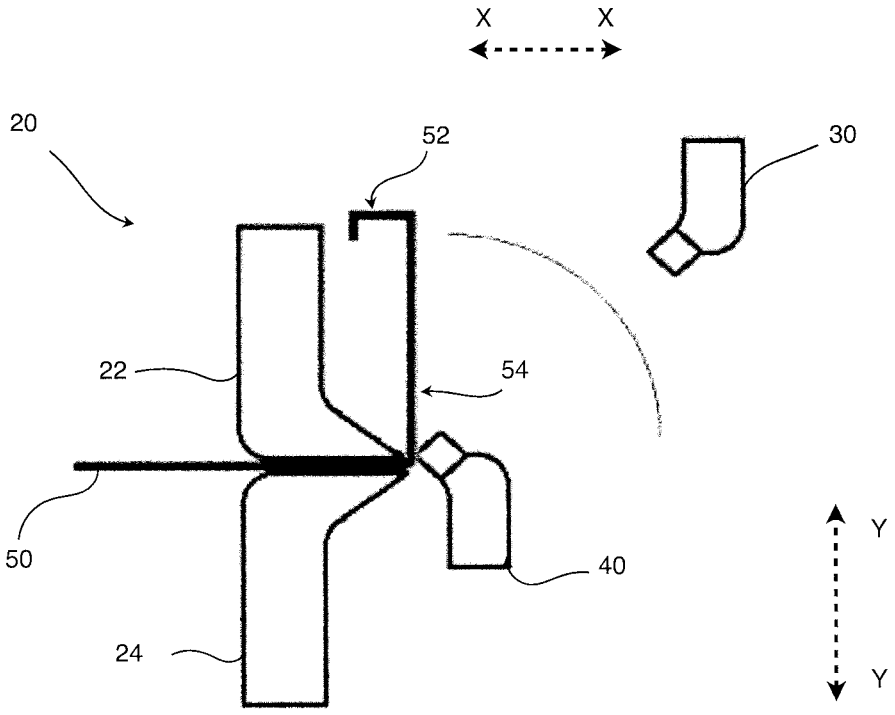

In a particularly advantageous further embodiment, the bending group 4 of the present invention enables realising a bend having a particularly large radius of a portion of a particularly extended metal sheet 50. As illustrated in FIG. 5, after having carried out a first C-shaped bending of a first portion 52 of a metal sheet 50, the metal sheet 50 is newly displaced internally of the bending group 4 according to an axial horizontal direction X-X and blocked by the presser elements 22, 24 so as to make the metal sheet 50 ready for a bending of a second portion 54. The lower bending member 40 is displaced upwards along the axial vertical direction Y-Y so as to exert a pressure on an area of the second portion 54 of metal sheet 50 and carry out a first bending with an angle of close to 90°. Owing to the size of the second portion 54, the upper bending member 30 is displaced along an axial horizontal direction X-X distant from the blocking press 20, exiting the area occupied by the trajectory (indicated in the figure with a broken line) of the second portion 54 of the metal sheet 50 during the bending step, and thus enabling complete bending thereof.

With this particular configuration of the bending group 4 of the present invention, it is also possible to improve and optimise other bending processes of known type, such as for example a "double thickness" type bending, in particular in a case in which the metal sheet is made up of a material having high yield strength, therefore with a high degree of elastic return.

At present, once a portion of end of a metal sheet is bent on itself, the metal sheet is positioned by the longitudinal positioner 9 under the blocking press 20 so as to complete the double-thickness bending and overcome the yield strength. However, owing to the elastic return, the portion of end of the metal sheet tends to newly open notwithstanding the pressure exerted.

With the bending group 4 of the present invention, while the portion of metal sheet is subjected to the pressure of the blocking press 20, it is possible to contemporaneously activate both the upper bending member 30 and the lower bending member 40 so that they contemporaneously exert a pressure at the end of the connecting radius of the bending with a pressure force value that is extremely limited so as to stabilise the bending carried out while maintaining the contact of the two thicknesses that the bend requires.

In a further embodiment of the present invention, the panelling machine tool 1 can comprise an electronic control unit (not illustrated) in communication with a memory system and an interface bus. The electronic control unit is configured so as to carry out instructions memorised in the memory system, and for sending and receiving signals from and/or towards the interface bus.

The memory system can include various types of storage including optical memorisation, magnetic memorisation in the solid state and/or other types of non-volatile memory. The interface bus can be configured so as to send, receive and modulate analog and digital signals from and/or towards sensors and control devices. The memorised instructions can include the previously-described procedure steps, thus enabling the electronic control unit to carry out the steps of these procedures and controlling the panelling machine tool 1.

According to a particularly advantageous characteristic, the panelling machine tool 1 can further comprise a plurality of sensors, connected to the electronic control unit, for example, but not limitedly, optical readers and/or laser readers, particularly suitable for determining the displacement of the portions of metal sheet before, during and/or after the bending step. In this way, the electronic control unit is able to verify the bending action of the bending members, evaluate the results obtained, and modify the parameters for displacements of the bending members with the aim of obtaining the bends as required by the profiled element to be realised.

All the details can be substituted by other technically-equivalent elements. Likewise, the materials used, as well as the forms and dimensions thereof, can be any according to needs without for this reason forsaking the scope of protection of the following claims.

The invention claimed is:

1. A bending group of a panelling machine tool for manufacturing profiled elements by bending a sheet of sheet metal, comprising:

a main frame;

a blocking press for blocking the sheet of sheet metal during the manufacturing;

a first bending member and a second bending member distinct from the first bending member, wherein both the first bending member and the second bending member are configured to carry out at least a bending of at least a portion of the sheet of sheet metal, and wherein at least one of the first bending member and the second bending member is movable with respect to the other;

a first support frame slidably connected to the main frame along an axial horizontal direction, wherein the first bending member is slidably connected to the first support frame along an axial vertical direction and a second support frame slidably connected to the main frame along the axial horizontal direction, wherein the second bending member is slidably connected to the second support frame along the axial vertical direction.

2. The bending group of claim 1, further comprising:

a first actuator device connected to the first bending member and to the first support frame, wherein the first actuator device is configured to move the first bending member along said axial vertical direction.

3. The bending group of claim 2, further comprising:

a third actuator device connected to at least the second bending member and to the second support frame, wherein the third actuator device is configured to move the second bending member along said axial vertical direction.

4. The bending group of claim 3, further comprising:

a second actuator device connected to the first support frame and to the main frame, wherein the second actuator device is configured to move the first supporting frame along said axial horizontal direction.

5. The bending group of claim 4, further comprising:

a fourth actuator device connected to the second support frame and to the main frame, wherein the fourth actuator device is configured to move the second support frame along said axial horizontal direction.

6. The bending group of claims 5, wherein the first actuator device and the second actuator device are configured to displace the first bending member in predetermined displacement trajectories, wherein the displacement trajectories are a result of an interpolation of a movement along the axial vertical direction and a movement along the axial horizontal direction, and, the third actuator device and the fourth actuator device are configured to displace the second bending member in further predetermined displacement trajectories, wherein the further displacement trajectories are a result of an interpolation of a movement along the axial vertical direction (Y-Y) and a movement along the axial horizontal direction, so that when the first bending member is displaced in one predetermined displacement trajectory thereof and the second bending member is displaced in one predetermined displacement trajectory thereof, the first bending member and the second bending member abut against a first portion of the sheet metal and exert a pressure that is sufficient to bend the first portion about an angle corresponding to the predetermined displacement trajectory, and the further predetermined displacement trajectory.

7. A panelling machine tool for production of profiled elements, comprising:

a loading station configured for loading a sheet of metal sheet to be processed; and a bending group according to claim 1.

8. A process for bending a portion of a sheet of sheet metal, comprising the following steps:

providing a blocking press for blocking the sheet of sheet metal during a bending of the sheet of sheet metal, providing a first bending member and a second bending member, distinct from the first bending member, wherein both the first bending member and the second bending member are configured to carry out at least a bending of at least a portion of the sheet of sheet metal, providing a first support frame slidably connected to the main frame along an axial horizontal direction, wherein the first bending member is slidably connected to the first support frame along an axial vertical direction, providing a second support frame slidably connected to the main frame along the axial horizontal direction, wherein the second bending member is slidably connected to the second support frame along an axial vertical direction, providing a first actuator device and second actuator device connected to the first bending member and configured to move the first bending member along the axial vertical direction and along the axial horizontal direction, respectively;

providing a third actuator device and a fourth actuator device connected to the second bending member and configured to move the second bending member along the axial horizontal direction and along the axial vertical direction, respectively;

independently moving the first bending member with respect to the second bending member along a trajectory comprising at least a component of the axial vertical direction and/or the axial horizontal direction so as to carry out a first C-shaped bending of a first portion of the sheet of sheet metal, displacing upwards the second bending member along the axial vertical direction so as to exert a pressure on an area of a second portion of the sheet of sheet metal so as to carry out a second bending with an angle of close to 90° , and wherein during the second bending, displacing the first bending member is displaced along the axial horizontal direction away from the blocking press, so as to exit the area occupied by the trajectory of the second portion of the sheet of sheet metal, and thus enabling the complete bending thereof.

* * * * *